US007134154B2

(12) United States Patent
Cloer et al.

(10) Patent No.: US 7,134,154 B2
(45) Date of Patent: Nov. 14, 2006

(54) CROSS-RAIL SUPPORT SYSTEM FOR A BED FRAME

(75) Inventors: Noah Moffat Cloer, Mooresville, NC (US); Edward G. Alala, Hickory, NC (US); Michael D. Shrewsbury, Bluefield, VA (US)

(73) Assignee: Hickory Springs Manufacturing Company, Hickory, NC (US)

( * ) Notice: Subject to any disclaimer, the term of this patent is extended or adjusted under 35 U.S.C. 154(b) by 0 days.

(21) Appl. No.: 11/069,603

(22) Filed: Mar. 1, 2005

(65) Prior Publication Data

US 2006/0195982 A1 Sep. 7, 2006

(51) Int. Cl.
*A47C 19/00* (2006.01)

(52) U.S. Cl. ..... 5/201; 5/203; 5/200.1; 5/310

(58) Field of Classification Search ..... 5/203, 5/201, 200.1, 222, 224, 185, 310
See application file for complete search history.

(56) References Cited

U.S. PATENT DOCUMENTS

| | | | |
|---|---|---|---|
| 1,088,468 | A | 2/1914 | Smith et al. |
| 1,105,487 | A | 7/1914 | Cassell |
| 2,093,164 | A | 9/1937 | DeBoer |
| 2,644,960 | A | 7/1953 | Blanke et al. |
| 2,772,424 | A | 12/1956 | Roche et al. |
| 2,877,470 | A | 3/1959 | Roth et al. |
| 2,930,052 | A | 3/1960 | Andreasen |
| 2,968,051 | A | 1/1961 | Imber et al. |
| 3,031,689 | A | 5/1962 | Sark |
| RE27,182 | E | 9/1971 | Fredman |
| 3,646,623 | A | 3/1972 | Harris et al. |
| 3,803,644 | A | 4/1974 | Harris |
| 3,848,280 | A | 11/1974 | Allen et al. |
| 3,881,202 | A | 5/1975 | Tyhanic |
| 3,945,064 | A | 3/1976 | Harris et al. |
| 4,007,502 | A | 2/1977 | Mis |
| 4,019,211 | A | 4/1977 | Spitz |
| 4,027,343 | A | 6/1977 | Hooker |
| 4,038,710 | A | 8/1977 | Tambascio |
| 4,070,717 | A | 1/1978 | Kitchen et al. |
| 4,078,271 | A | 3/1978 | Tambascio |
| 4,080,674 | A | 3/1978 | Fredman et al. |
| 4,103,374 | A | 8/1978 | Knoke |
| 4,106,141 | A | 8/1978 | Hooker |
| 4,135,266 | A | 1/1979 | Knoke |
| 4,276,665 | A | 7/1981 | Mis |
| 4,295,234 | A | 10/1981 | Whitehead |
| 4,354,287 | A | 10/1982 | Fredman |

(Continued)

OTHER PUBLICATIONS

Advertisement for the MUSCLE 2000, 2 sheets, believed to be publicly available prior to Jan. 11, 2004, published by Glideaway Bed Carriage Manufacturing Company.

(Continued)

*Primary Examiner*—Alexander Grosz
(74) *Attorney, Agent, or Firm*—Alston & Bird LLP

(57) ABSTRACT

A cross-rail support system for use with a bed frame to support a mattress having at least two adjustable support leg assemblies attached to two parallel and adjacent elongate beams. The overall width of the support system is adjustable by sliding the elongate beams relative to each other along their lengths. The placement of the two support leg assemblies is also adjustable by sliding the assemblies along the elongate beams and is independent from the total width of the support system. In addition, the leg assemblies maintain the parallel alignment of the elongate beams to each other and provide support to the mattress.

25 Claims, 2 Drawing Sheets

U.S. PATENT DOCUMENTS

| | | | | |
|---|---|---|---|---|
| RE31,384 | E | | 9/1983 | Mis |
| 4,679,261 | A | * | 7/1987 | Stanley et al. ..... 5/183 |
| 4,724,559 | A | | 2/1988 | Bly et al. |
| 5,161,268 | A | | 11/1992 | Harrow |
| 5,203,039 | A | | 4/1993 | Fredman |
| 5,231,713 | A | | 8/1993 | McDonnell |
| 5,375,370 | A | | 12/1994 | Zimmermann |
| 5,477,571 | A | | 12/1995 | Roggenkamp et al. |
| 5,502,852 | A | | 4/1996 | Fredman et al. |
| 5,520,360 | A | | 5/1996 | Wensman |
| 5,582,582 | A | | 12/1996 | Chapman |
| 5,815,860 | A | | 10/1998 | Mitchell |
| 5,881,979 | A | | 3/1999 | Rozier, Jr. et al. |
| 5,894,614 | A | | 4/1999 | Stroud |
| 5,996,145 | A | | 12/1999 | Taylor |
| 6,006,379 | A | | 12/1999 | Hensley |
| 6,006,382 | A | | 12/1999 | Smith |
| 6,115,858 | A | | 9/2000 | Mitchell |
| 6,134,728 | A | | 10/2000 | Hernandez |
| 6,135,401 | A | | 10/2000 | Chen |
| 6,138,305 | A | | 10/2000 | Smith |
| 6,209,155 | B1 | | 4/2001 | Epstein et al. |
| 6,216,289 | B1 | | 4/2001 | Woods |
| 6,269,498 | B1 | | 8/2001 | Perkins |
| 6,272,705 | B1 | | 8/2001 | Jones |
| 6,289,535 | B1 | | 9/2001 | Hernandez |
| 6,301,732 | B1 | | 10/2001 | Smith |
| 6,381,777 | B1 | | 5/2002 | Mitchell |
| 6,397,413 | B1 | | 6/2002 | Epstein et al. |
| 6,477,726 | B1 | | 11/2002 | Hernandez |
| 6,520,461 | B1 | | 2/2003 | Graham |
| 6,560,796 | B1 | | 5/2003 | Diforio |
| 6,625,827 | B1 | | 9/2003 | Polevoy et al. |
| 6,678,907 | B1 | | 1/2004 | Voelker et al. |
| 6,708,358 | B1 | | 3/2004 | Hensley |
| 2002/0059678 | A1 | | 5/2002 | Hernandez |
| 2002/0063072 | A1 | | 5/2002 | Pham |

OTHER PUBLICATIONS

Assembly Instructions for the Strong Arm Support System, one sheet, believed to be publicly available prior Jan. 11, 2004, published by Hickory Springs, Mfg. Co.

Assembly Instructions for Center Support Systems for Beds With Wood Side Rails, one sheet, dated Jun. 23, 1999, published by Glideaway Bed Carriage Manufacturing Company.

Advertisement for various Glideaway bed frames and cross bar support systems, 6 sheets (numbered 3, 4, 10, 11, 12 & 17), believed to be publicly available prior to Jan. 11, 2004.

Illustrations of Deluxe K-Metal Center Support MCS-1296 and Regular K-Metal Center Support MCS-1295 support systems, 1 sheet, believed to be publicly available prior to Jan. 11, 2004.

Photographs of three support systems, 1 sheet, believed to be publicly available prior to Jan. 11, 2004.

A print-out illustrating a center support from www.southernfishing.com/centersupport.shtml and www.southernfishing.com/media/images/random/flyer_pic1.gif , printed on Mar. 29, 2006, 2 pages (appears to be a commercial embodiment of U.S. Patent No. 6,560,796; the collar in the illustrated center support appears to be held to one of the longitudinal members by a screw similar to the screws used to hold the central bracket to the longitudinal members).

* cited by examiner

CROSS-RAIL SUPPORT SYSTEM FOR A BED FRAME

FIELD OF THE INVENTION

The present invention relates to the field of bed support frames for supporting mattresses, and more particularly to cross-rail supports that are adjustable to fit bed frames that support a range of mattress sizes.

BACKGROUND OF THE INVENTION

Conventional beds generally include a frame, a box spring that is supported by the frame and a mattress that rests on top of the box spring. Conventional frames generally consist of a headboard, footboard, and two pairs of spaced, parallel side rails that form a rectangle that conforms to the shape of the box spring to be placed thereon. The spaced parallel side rails support the outer periphery of the box spring mattress. Although sufficient for most smaller beds, the rectangular configuration fails to sufficiently support the center of most larger beds, such as queen or king-sized beds. Up to 70% of the weight of a sleeper rests on the center "support zone" of the bed and a lack of support in the support zone can result in bowing of the mattress and instability. Such bowing and instability of the mattress can result in discomfort for the sleeper and excessive wear on the mattress and bed frame.

One approach to providing support to the center zone of the bed is to use a plurality of wooden slats (or cross-rail supports) that rest on the side rails of the frame and extend along the width of the bed. However, wooden slats are generally undesirable due to their lack of rigidity and tendency to sag, warp or break after extended exposure to the weight of the bedding and/or the sleeper.

Undue sag or deflection of the cross-rail support may be avoided by using stiffer materials, such as metal rails in place of the wood slats. Further support for the mattress may be achieved by using a leg, or legs, attached to the cross-rail. The legs rest on the floor and are located beneath the support zone of the bed, supporting the cross-rail from below. Although an improvement over wooden slats, metal cross-rails of varying sizes are needed to fit each individual type of bed size. Given the large number of bed widths, retailers frequently encounter the problem of having too many, or too few, of a certain type of cross-rail support.

Currently, adjustable cross-rail supports are used in the bedding industry to allow the cross-rail supports to be lengthened or shortened to support different sized beds. In addition to their adjustable overall widths, another feature to these adjustable cross-rail supports is the use of a plurality (usually two) of leg supports which allows for better support to the support zone.

However, the placement of the leg supports relative to the side rails is often dependent on the overall width of the cross-rail support. It would be advantageous to have a cross-rail support system with an adjustable overall width to fit varying sizes of mattresses and adjustable leg supports where the placement of the leg supports along the support system is independent from the overall width of the support system. This would allow for the placement of the leg supports to be determined not based on the width of the mattress but rather for support and comfort or other considerations such as possible obstructions underneath the bed. Furthermore, it would be advantageous if the support system was easy to use and required a minimal number of parts.

BRIEF SUMMARY OF THE INVENTION

The present invention addresses the above needs and achieves other advantages by providing a cross-rail support system having a number of adjustable support leg assemblies attached to two parallel and adjacent elongate beams. The overall width of the support system is adjustable by sliding the elongate beams relative to each other along their lengths. The placement of the support leg assemblies is also adjustable by sliding the assemblies along the elongate beams and is independent from the total width of the support system. In addition, the leg assemblies maintain the parallel alignment of the elongate beams to each other and provide support to the mattress.

In one embodiment, the present invention includes a cross-rail support system for use with a bed frame to support a mattress. The cross-rail support system has a pair of elongate beams and at least two leg assemblies. The elongate beams are in a parallel alignment to each other and together define an overall width between their outer ends that extends across the bed frame. The leg assemblies maintain the parallel alignment between the beams and provide support to the mattress. Each assembly includes an elongate tube and a leg structure. Each elongate tube defines at least one interior space for holding the elongate beams side by side and allowing the sliding of the elongate beams along the lengths of each other thereby adjusting the overall width of the cross-rail support system. Each leg structure depends from the elongate tube of its respective leg assembly and has a height that extends generally perpendicular to the elongate beams. Also, the leg assemblies are slideable along the lengths of the elongate beams relative to each other and independently from the overall width of the elongate beams so that the positions of the leg assemblies and overall width of the cross-rail support system are independently adjustable.

In other embodiments, the cross-rail support system has one or more leg assemblies. Each leg assembly also may have at least one locking member for inhibiting each leg assembly and the elongate beams from sliding when the locking member is engaged. Also, the height of each leg structure may be adjustable. For example, the leg structures may comprise a series of telescoping extensions. Further, a locking member may be included on the leg structure such that when engaged the height of the leg structure is fixed. The elongate beams and elongate tubes may be rectangular in shape. In another aspect, each leg structure depends from its respective elongate tube at a position closer to an outer end of that elongate tube. Brackets may also be affixed to the outer ends of each elongate beam for engaging the side rails of a bed frame Another embodiment of the invention includes a bed frame assembly for supporting a mattress. The bed frame assembly includes a pair of side rails, a pair of ends, and at least one of the cross-rail support systems. The pair of side rails and the pair of ends are interconnected forming a rectangular frame. The cross-rail support system or systems are connected to the side rails between the ends.

Yet another embodiment of the invention is a method for installing a cross-rail support system. The method includes inserting each elongate beam through the interior space of each support leg assembly, adjusting the overall width of the cross-rail support system by sliding the elongate beams relative to each other so that an outer end of each elongate beam can engage the bed frame, and adjusting the placement of the support leg assemblies on the elongate beams by sliding the support leg assemblies along the length of the elongate beams.

The method may also include locking the support leg assemblies by engaging a locking mechanism on each support leg assembly so that the support leg assemblies are inhibited from sliding along the elongate beams. Further, the invention may include adjusting the height of each of the support leg assemblies so that each leg assembly contacts a support platform, such as a floor, and then engaging a locking member on the leg assembly to inhibit the height from being undesirably changed.

The present invention has several advantages. The leg assemblies provide both the rigidity required to maintain the parallel alignment of the elongate beams and the overall support to the mattress. Therefore more complex or additional elements such as collars are not required. Also the width of the support system is adjustable allowing the support system to work with any of the common size mattresses. The placements of the leg assemblies are adjustable as well. Furthermore, the placement of the leg assemblies relative to the side rails is independent from the overall width of the support system. Further, a combination of a screw stem floor glide and the series of telescoping extensions with locking screws and the groove in the outer telescoping extension allows for maximum extension or shortening of the leg structure. Each leg structure depending from a position closer to the outer end of its respective elongate tube allows for the leg structures to be set proximate the side rails if required or desired.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying figures, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Figure 1:
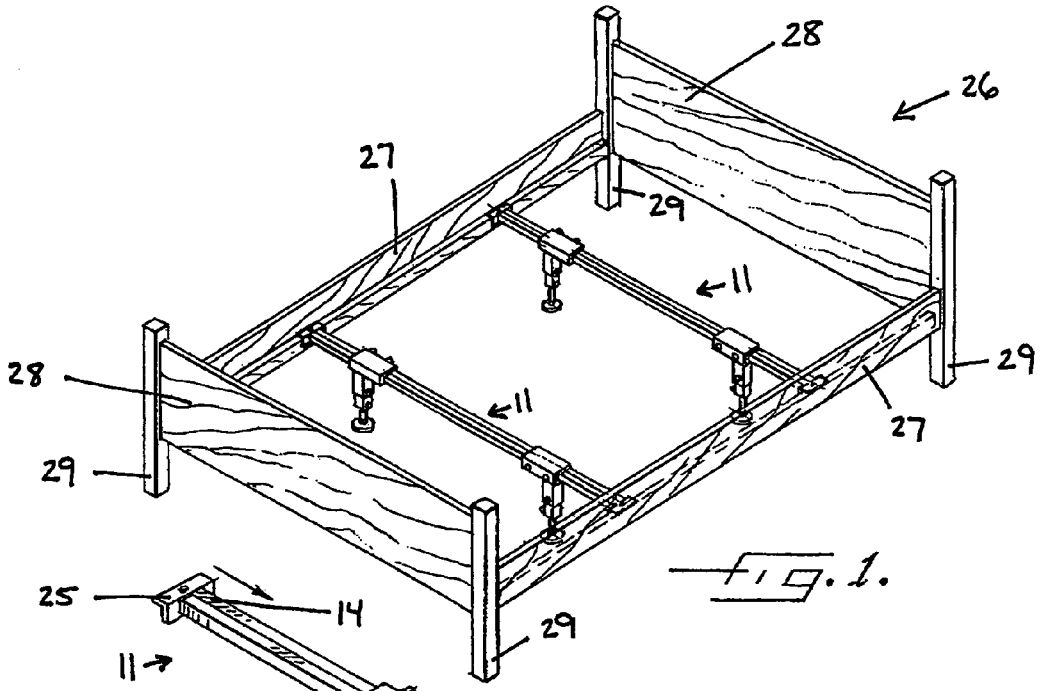
FIG. 1 is a perspective view of a bed frame assembly of the present invention, including a pair of cross-rail support systems.
Figure 2:
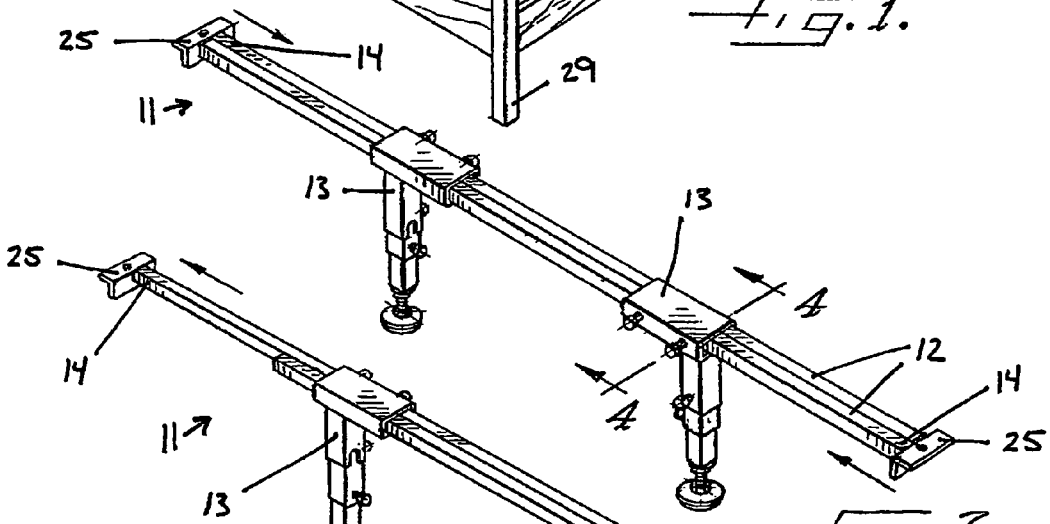
FIG. 2 is a perspective view of one embodiment of the cross-rail support system of the present invention and of the kind used in the bed frame assembly of FIG. 1.
Figure 3:
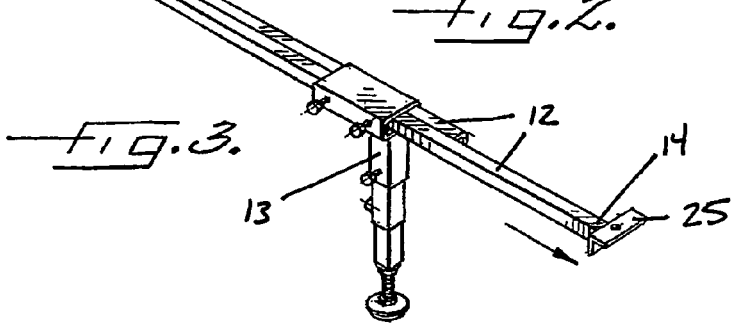
FIG. 3 is a perspective view of the same cross-rail support system as FIG. 2 shown with the overall width adjusted for a greater width and the height of the leg structures adjusted for a greater height.

In general, as shown in the figures, the present invention includes a cross-rail support system 11 for use with a bed frame. In FIG. 1, a bed frame 26 is shown for supporting a box spring and a mattress. The bed frame 26 includes a pair of side rails 27 and a pair of ends 28 such as a headboard and footboard that are interconnected to form a generally rectangular frame and at least one of the cross-rail support systems 11 according to the invention. The cross-rail support system or systems 11 are adapted for engaging the side rails 27. The ends 28 of the bed frame 26 have additional legs 29 to support the mattress. Although the illustrated bed frame 26 of FIG. 1 is constructed from wood, the bed frame may be constructed from a variety of materials. For example, the side rails 27 and/or the ends 28 may be metallic.

The cross-rail support system 11 includes a pair of elongate beams 12 in a general parallel alignment and a number of leg assemblies 13. The overall width of the support system 11 is defined by the distance between the two outer ends 14 of the elongate beams 12. Advantageously, the leg assembly or assemblies 13 maintain the parallel alignment of the elongate beams 12 and provide the support for the mattress. Each leg assembly 13 has an elongate tube 15 and a leg structure 16. Each elongate tube 15 defines at least one interior space 17 for holding the elongate beams 12 and facilitating the sliding of the elongate beams 12 along their lengths relative to each other thereby adjusting the overall width of the support system 11. The length of the elongate tube 15 provides lateral constraint against the elongate beams 12 which maintains their parallel alignment. For example, the length of the elongate tube 15 may be five inches. The interior space or spaces 17 of each leg assembly 13 also facilitates the advantageous adjustability of the placement of each leg assembly 13 along the length of the elongate beams 12 independently from any other leg assembly 13 and from the overall width of the support system 11. Each leg structure 16 depends from the elongate tube 15 of that leg assembly 13 and has a height generally perpendicular to the elongate beams 12. The leg structure 16 may be welded to the elongate tube 15 as shown or connected in some other manner.

The height of each leg structure 16 may be adjustable. For example, as illustrated, the leg structure 16 may comprise a series of telescoping extensions 18, where the height of the leg structure 16 is adjusted by moving the extensions 18 in and out of one another. Further, as illustrated, the leg structure 16 may have a floor glide 19 with a screw-type stem 20 that engages an insert 21 in the bottom telescoping extension 18*a* for further adjusting.

Locking members may be used to fix the height of the leg structure 16. For example, as illustrated, the leg assembly 13 may have a series of locking screws 22*a*. Specifically, the locking screws 22*a* may be used by inserting and extending the screws 22*a* through and into threaded through-holes 23*a* on the telescoping extensions 18 and/or other parts of the leg structure so that the ends of the screws 22*a* tighten against the next inner telescoping extension 18 thereby creating a frictional engagement between the extensions 18 and inhibiting movement between them.

In another aspect, the locking members may be configured to allow the maximum extension or shortening of the leg structure 16. As an example and as illustrated, one or more of the telescoping extensions 18 and/or other parts for the leg structure may have a groove 24 for receiving the next lower locking member. The groove 24 allows for the shortening on the leg structure 16 without the interference from the locking members. This advantageously shortens the length of the leg structure 16 for a given maximum extension length, which allows a greater range of adjustability and lower shipping costs.

Also, locking members may be employed to fix the placement of the leg assemblies 13 along the elongate beams 12 and the overall width of the support system 11. As an example and similar to the locking members described above, locking screws 22*b* may be used by inserting and extending the screws 22*b* through and into threaded through-holes 23*b* on the elongate tubes 15 so that the ends of the screws 22*b* tighten against one of the elongate beams 12 creating a frictional engagement between the elongate beam 12 and the leg assembly 13 thereby inhibiting movement between the two.

In at least one embodiment and as illustrated, each elongate tube 15 defines one interior space 17 for holding the elongate beams 12 immediately adjacent to each other or side-by-side. Therefore, tightening the end of the locking screw 22*b* against one of the elongate beams 12 creates a frictional engagement between both elongate beams 12 and the leg assembly 13 thereby inhibiting the leg assembly 13 and both elongate beams 12 from sliding.

Figure 4:
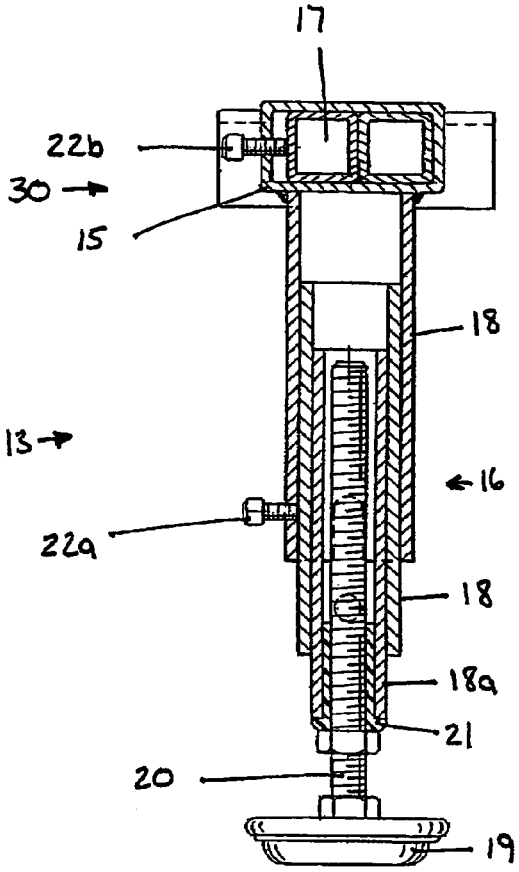
FIG. 4 is a cross-section view of the cross-rail support system taken along the 4—4 line of FIG. 2.
Figure 5:
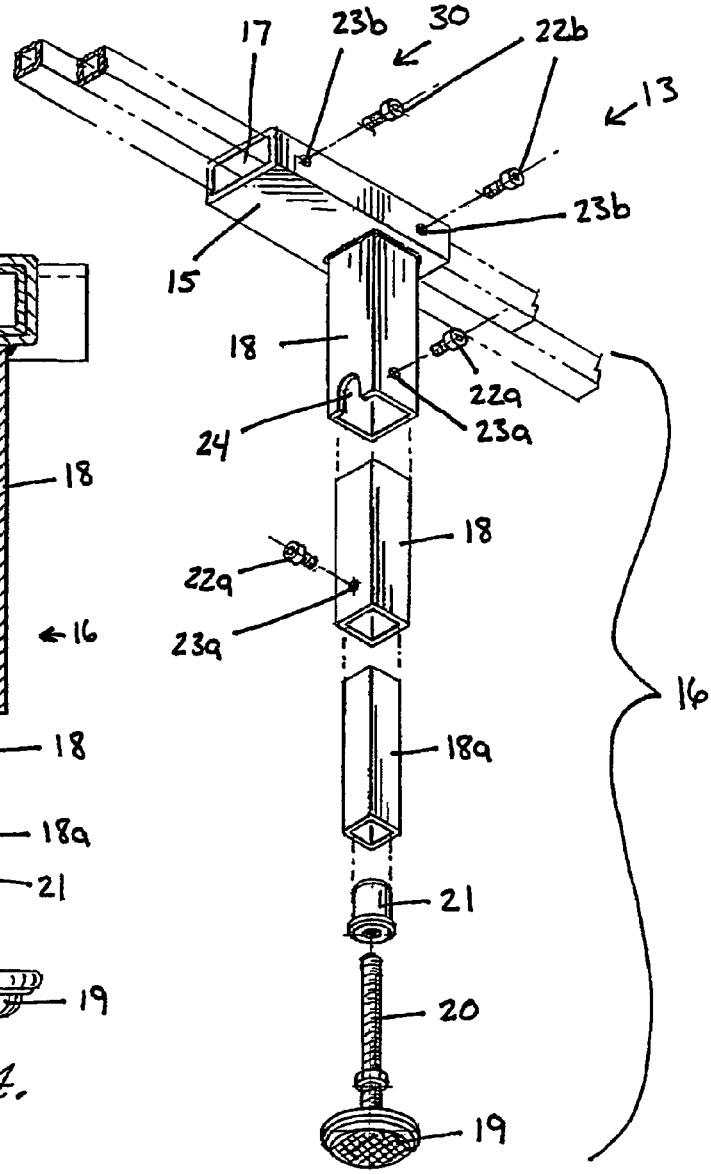
FIG. 5 is an exploded view of one embodiment of a leg assembly of the present invention.

It should be noted that, as shown in FIG. 4, the elongate beams 12 may not occupy the entire interior space 17. For example, a one-eighth inch clearance may exist between the elongate beams 12 and the elongate tube 15.

Also shown in the illustrated embodiment is the placement of all of the locking screws 22*b* for inhibiting the sliding of the leg assembly 13 and at least one of the elongate beams 12 on one side 30 of each elongate tube 15. The side 30 of each elongate tube 15 containing the locking screws 22*b* is on the opposite side of the cross-rail support system 11 longitudinally from the locking screws 22*b* on the other elongate tube 15.

Another aspect of the invention is the manner in which each leg structure 16 depends from its respective elongate tube 15. Although each leg structure 16 may be positioned in the center of its respective tube 15, in the illustrated embodiment each leg structure 16 depends from its respective elongate tube 15 at a position closer to an outer end of the elongate tube 15. This is advantageous because it allows a leg structure 16, which is providing the support to the bed, to be positioned closer to the side rails 27 when necessary compared to if the leg structure 16 was centered on the elongate tube 15.

The support system 11 may also employ brackets 25 affixed to the outer ends 14 of the elongate beams 12 for engaging the side rails 27 of a bed frame 26. As illustrated in the figures, the brackets 25 may be L-shaped with each having a vertical face and a horizontal face for engaging a side and top surface of the side rail 27. The side rails 27 often have an inner wooden strip for receiving the box spring to which the brackets 25 can be fastened. Also the bracket 25 may use a fastener, such as a wood screw, to hold the bracket 25 in place. Although the figures illustrate an L-shaped bracket 25, it should be noted that other bracket structures may be used. For example, the bracket may be U-shaped.

Although the figures illustrate a bed frame 26 with two cross-rail support systems 11 each with two leg assemblies 13, one skilled in the art would appreciate the different number of cross-rail support systems 11 and leg assemblies 13 that will work with this invention. For example, a cross-rail support system 11 may have only one leg assembly 13, and a one-legged embodiment may be part of a set of three cross-rail systems 11 for a single bed frame 26.

The cross-rail support system 11 can be easily assembled and installed on-site for use by a purchaser with a newly acquired bed frame, or with a preexisting bed frame. To assemble the support system 11, each leg assembly 13 is slid over and around one of the elongate beams 12 one at a time via the interior spaces 17 of the leg assemblies 13. The second elongate beam 12 is then inserted through the interior spaces 17 of each leg assembly 13 such that the elongate beams 12 are placed in a parallel alignment.

Alternatively, instead of placing all the leg assemblies 13 on one elongate beam 12 then inserting the second elongate beam 12 through the leg assemblies 13, one leg assembly 13 may be placed on each elongate beam 12 then each elongate beam 12 may be inserted in the other leg assembly 13 that is already holding the other elongate beam 12. It should also be understood that the system can be shipped to a retailer or consumer in a preassembled form.

Once the elongate beams 12 are inserted into and being held by the leg assemblies 13, the overall width of the support system 11 may be adjusted by sliding the elongate beams 12 along the lengths of each other. The width of the support system 11 is most likely determined by the distance between the side rails 27 of the bed frame 26. Therefore, it is desirable to first place the support system 11 in the center of the bed frame 26 then adjust the width of the support system 11 so that the outer ends 14 of the elongate beams 12, or brackets 25 if present, contact or engage the side rails 27. Depending on whether brackets 25 are present, fasteners may then be used to secure the brackets 25 against the side rails 27.

The placement of the leg assemblies 13 may be adjusted by sliding each leg assembly 13 along the length of the elongate beams 12 to the desired locations. The placement of the leg assemblies 13 is dependent on the comfort preferences of the user(s) of the bed, the strength of the bed or frame, the expected load on the bed, and/or the availability of space underneath the bed. Once the leg assemblies 13 are in the desired locations, the locking members may be engaged to fix the location of the leg assemblies 13 and the width of the support system 11. If locking screws 22*b* are used, this may be accomplished by rotating the screws 22*b* into the elongate tubes 15 through the threaded through-holes 23*b* thereby creating a frictional engagement between the elongate beams 12 and the elongate tubes 15.

The height of the leg structures 16 may be adjusted by moving the telescoping extensions 18 in and out of each other and/or extending or shortening the screw stem 20 of the floor glide 19. The height of the leg structures 16 is dependent on the distance between the support system 11 and the floor. Once the height is adjusted such that the floor glides 19 are in contact with the floor, the leg structure's height may be fixed in place using similar locking screws 22*a* as used to lock the placement of the leg assemblies 13 above.

It should be noted that the cross-rail support system 11 can be easily disassembled as well. To disassemble the support system 11, the user unfastens any fasteners that are securing the brackets to the side rails and disengages the locking screws 22*b* in the elongate tubes 15, after which the elongate beams 12 are free to slide out and clear of the leg assemblies 13. The leg structures 16 can be adjusted to the shortest height position to minimize the space required to store or ship the disassembled cross-rail support system 11.

The present invention has several advantages. The leg assembly or assemblies 13 provide both the rigidity required to maintain the parallel alignment of the elongate beams 12 and the overall support to the mattress. Therefore more complex or additional elements such as collars are not required. Further, the elongate beams 12 are inexpensive to manufacture and provide long-term durability to the support system 11. Also, the width of the support system 11 is adjustable allowing the support system 11 to work with any of the common size mattresses. The placements of the leg assemblies 13 are adjustable as well. Furthermore, the placement of the leg assemblies 13 relative to the side rails 27 is independent from the overall width of the support system 11. Further, the combination of the screw stem floor glide 19 and the series of telescoping extensions 18 with locking screws 22*a* and the groove 24 in the outer telescoping extension allows for maximum extension or shortening of the leg structures 16. Each leg structure 16 depending from a position closer to the outer end of its respective elongate tube 15 allows for the leg structures 16 to be set proximate the side rails 27 if required or desired.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A cross-rail support system for use with a bed frame to support a mattress, the cross-rail support system comprising:

a pair of elongate beams in parallel alignment, each having an inner end and an outer end and together defining an overall width between the outer ends that extends across the bed frame; and at least two leg assemblies for maintaining the parallel alignment between the beams and providing support to the mattress, each leg assembly including, an elongate tube that defines at least one interior space for holding the elongate beams, wherein the elongate beams are slideable relative to each other thereby adjusting the overall width of the cross-rail support system, and a leg structure depending from the elongate tube and having a height that extends generally perpendicular to the elongate beams, wherein the leg assemblies are slideable along at least one of the elongate beams and independently from the overall width of the elongate beams together so that the positions of the leg assemblies and the overall width of the cross-rail support system are independently adjustable; and wherein at least one of the leg assemblies is slidable past the inner end of at least one of the elongate beams.

2. The cross-rail support system of claim 1, further comprising a bracket affixed to the outer end of each elongate beam for engaging the cross-rail support system to the bed frame.

3. The cross-rail support system of claim 1, wherein each leg assembly further comprises at least one locking member for inhibiting that leg assembly and at least one of the elongate beams from sliding when said locking member is engaged.

4. The cross-rail support system of claim 3, wherein the interior spaces defined by each elongate tube for holding the elongate beams holds the elongate beams immediately adjacent to each other and the engagement of at least one locking member of a leg assembly inhibits that leg assembly and both elongate beams from sliding.

5. The cross-rail support system of claim 3, further comprising two leg assemblies and two locking members on each leg assembly for inhibiting that leg assembly and at least one elongate beam from sliding.

6. The cross-rail support system of claim 5, wherein the locking members on a leg assembly for inhibiting that leg assembly and at least one elongate beam from sliding are on a side of that leg assembly that is on an opposite side of the cross-rail support system from the locking members of the other leg assembly.

7. The cross-rail support system of claim 1, wherein the height of each leg structure is adjustable.

8. The cross-rail support system of claim 7, wherein the leg structure comprises a series of telescoping extensions.

9. The cross-rail support system of claim 8, wherein each leg structure has at least one locking member for inhibiting the height of that leg structure from changing when the at least one locking member is engaged.

10. The cross-rail support system of claim 1, wherein each leg structure depends from its respective elongate tube at a position closer to an outer end of that elongate tube.

11. A bed frame assembly for supporting a mattress, the assembly comprising:

a bed frame having a pair of side rails and a pair of ends wherein the side rails and ends are inter-connected forming a generally rectangular frame; and at least one cross-rail support system adapted for engaging the side rails, wherein each cross-rail support system comprises:

a pair of elongate beams in parallel alignment each having an inner end and an outer end and together defining an overall width between the outer ends that extends across the bed frame; and at least two leg assemblies for maintaining the parallel alignment between the beams and providing support to the mattress, each leg assembly including, an elongate tube that defines at least one interior space for holding the elongate beams, wherein the elongate beams are slideable relative to each other thereby adjusting the overall width of the cross-rail support system, and a leg structure depending from the elongate tube having a height that extends generally perpendicular to the elongate beams, wherein the leg assemblies are slideable along at least one of the elongate beams and independently from the overall width of the elongate beams together so that the positions of the leg assemblies and the overall width of the cross-rail support system are independently adjustable; and wherein at least one of the leg assemblies is slidable past the inner end of at least one of the elongate beams.

12. The bed frame assembly of claim 11, wherein each cross-rail support system further comprises a bracket affixed to the outer end of each elongate beam for engaging that cross-rail support system to the side rails.

13. The bed frame assembly of claim 11, wherein each leg assembly further comprises at least one locking member for inhibiting that leg assembly and at least one of the elongate beams from sliding when said locking member is engaged.

14. The bed frame assembly of claim 13, wherein the interior spaces defined by each elongate tube for holding the elongate beams holds the elongate beams immediately adjacent to each other and the engagement of at least one locking member of a leg assembly inhibits that leg assembly and both elongate beams from sliding.

15. The bed frame assembly of claim 14, further comprising two leg assemblies and two locking members on each leg assembly for inhibiting that leg assembly and at least one elongate beam from sliding.

16. The bed frame assembly of 15, wherein the locking members on a leg assembly for inhibiting that leg assembly and at least one elongate beam from sliding are on a side of that leg assembly that is on an opposite side of the cross-rail support system from the locking members of the other leg assembly.

17. The bed frame assembly of claim 11, wherein the height of each leg structure is adjustable.

18. The bed frame assembly of claim 17, wherein the leg structure comprises a series of telescoping extensions.

19. The bed frame assembly of claim 18, wherein each leg structure has at least one locking member for inhibiting the height of that leg structure from changing when the at least one locking member is engaged.

20. The bed frame assembly of claim 11, wherein each leg structure depends from its respective elongate tube at a position closer to an outer end of that elongate tube.

21. The bed frame assembly of claim 11, further comprising two cross-rail support systems.

22. A cross-rail support system for use with a bed frame to support a mattress, the cross-rail support system comprising:

a pair of elongate beams in parallel alignment, each having an inner end and an outer end and together defining an overall width between the outer ends that extends across the bed frame; and at least one leg assembly for providing support to the mattress, wherein the at least one leg assembly is slideable along the elongate beams independently from the overall width so that the position of each leg assembly and the overall width of the cross-rail support system are independently adjustable and wherein the at least one leg assembly is slidable past the inner end of at least one of the elongate beams, each leg assembly including, an elongate tube that defines at least one interior space for holding the elongate beams immediately adjacent to each other and allowing the elongate beams to slide relative to each other, and thus adjust the overall width of the cross-rail support system, a leg structure depending from the elongate tube having a height that extends generally perpendicular to the elongate beams, and at least one locking member for inhibiting the elongate beams from sliding relative to each other and for inhibiting the leg assembly from sliding relative to at least one of the elongate beams when the locking member is engaged.

23. The cross-rail support system of claim 22, wherein the height of each leg structure is adjustable.

24. The cross-rail support system of claim 23, wherein the leg structure comprises a series of telescoping extensions.

25. The cross-rail support system of claim 24, wherein each leg structure has at least one locking member for inhibiting the height of that leg structure from changing when the at least one locking member is engaged.

* * * * *